United States Patent [19]

Hara

[11] 3,943,607

[45] Mar. 16, 1976

[54] PLASTIC BINDER

[75] Inventor: Kunio Hara, Sagamihara, Japan

[73] Assignee: Nifco Inc., Tokyo, Japan

[22] Filed: Aug. 14, 1974

[21] Appl. No.: 497,407

[30] Foreign Application Priority Data

Aug. 15, 1973 Japan ..... 48-90823

[52] U.S. Cl. ..... 24/16 PB; 24/206 A; 59/78

[51] Int. Cl.[2] ..... B65D 63/00

[58] Field of Search ..... 24/16 PB, 206 A, 30.5 P, 24/17 AP, 30.5 T, 116 A; 403/346; 46/28; 59/78, 80, DIG. 1, 82

[56] References Cited

UNITED STATES PATENTS

| | | | |
|---|---|---|---|
| 2,714,269 | 8/1955 | Charles | 63/4 |
| 2,844,910 | 7/1958 | Korchak | 46/28 |
| 2,845,748 | 8/1958 | Derham | 46/152 |
| 3,019,552 | 2/1962 | Schleich | 46/162 |
| 3,780,401 | 12/1973 | Reimer | 24/16 PB |
| 3,833,972 | 9/1974 | Brumlik | 24/204 |

FOREIGN PATENTS OR APPLICATIONS

| | | | |
|---|---|---|---|
| 1,083,694 | 9/1967 | United Kingdom | 24/116 A |
| 1,227,829 | 10/1966 | Germany | 24/16 PB |
| 1,331,581 | 5/1963 | France | 403/346 |
| 1,332,239 | 6/1963 | France | 24/16 PB |

*Primary Examiner*—Bernard A. Gelak

*Attorney, Agent, or Firm*—Jack R. Halvorsen; Robert W. Beart

[57] ABSTRACT

A binder of a plastic material is disclosed which comprises a slender shaft with a suitable thickness and a plurality of disc-shaped flanges disposed at fixed intervals in the longitudinal direction of the said shaft. Articles given to be fastened are bundled or bound by winding this binder around the articles, crossing the loose remaining ends of the binder each other at right angles and pressing the corresponding pairs of adjacent flanges into entanglement.

1 Claim, 4 Drawing Figures

Fig. 3
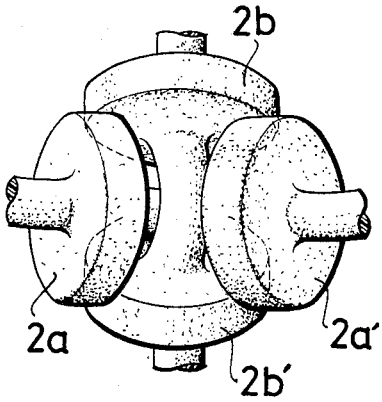
Fig. 1
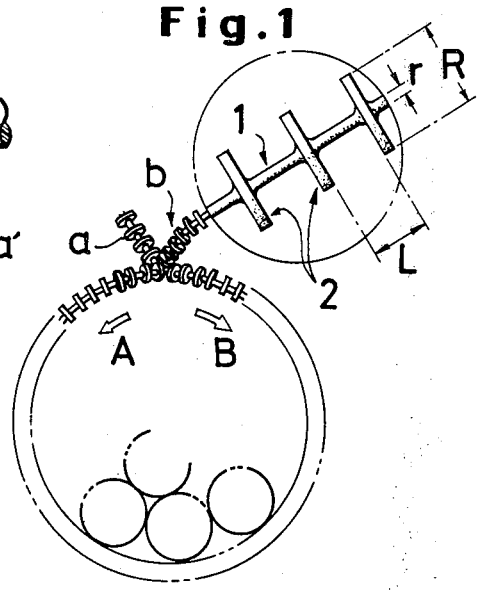
Fig. 4
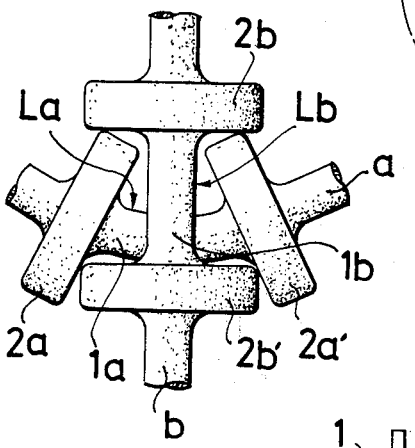
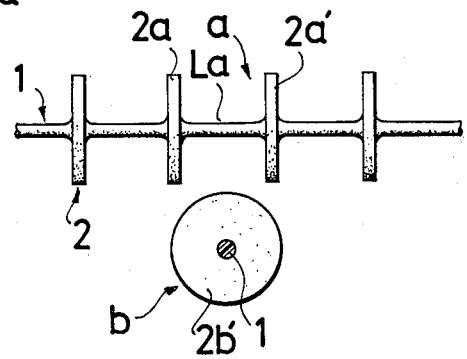
Fig. 2

PLASTIC BINDER

BACKGROUND OF THE INVENTION

This invention relates to a flexible binder formed of a plastic material possessed of suitable elasticity such as nylon 6, polyethylene or polyproylene and used for binding given articles in the same manner as by use of a metallic wire.

It has heretofore been practiced to bind or bundle articles such as bars and wires with a metallic wire. In this practice, the loose remaining ends of the wire wound around the articles must be twisted around each other at least once and generally several times in order for the wire to be kept fast in that fastened state around the bound articles. And the work of twisting must be carried out with the aid of a tool unless the metallic wire to be used is one of a very small thickness. Otherwise the twisting cannot be accomplished successfully without hurting the inner surfaces of the thumb and the index finger.

An object of this invention is to provide a plastic binder which can be handled simply by fingers without the aid of any tool in producing the same state of fast binding as has heretofore been accomplished by means of a metallic wire.

SUMMARY OF THE INVENTION

To attain the object described above in accordance with the present invention, there is provided a binder which comprises a slender shaft and a plurality of flanges disposed at fixed intervals in the longitudinal direction of the said shaft, wherein the interval between each pair of adjacent flanges is slightly smaller than the flanges diameter. Given articles are bound by winding the binder of the construction described above around the articles, crossing the loose remaining ends of the binder each other at right angles and pushing two adjacent flanges at one of the said ends forcibly between the corresponding adjacent flanges at the other end. As the two pairs of flanges are pushed into each other, the intervals of the shaft between the corresponding pairs of adjacent flanges slightly expand and at the same time bend and get entangled with each other. Because of the bending in the said intervals of the shaft, the adjacent flanges at one end are inclined toward each other and consequently prevent the other pair of adjacent flanges from being disentangled. Thus, adjacent flanges at one end of the binder are retained entangled with the corresponding interval at the other end of the shaft.

By simple manipulation with fingers, the binder according to the present invention can bundle given articles as securely as can be accomplished by use of the conventional metallic wire.

Other objects and other features of the present invention will become apparent from the description to be given in further detail herein below with reference to the accompanying drawings.

BRIEF EXPLANATION OF THE DRAWING

FIG. 1 is a partially enlarged explanatory diagram illustrating the binder according to the present invention in the state in which the binder is wound around given articles and fastened by having the loose ends thereof entangled.

FIG. 2 is an explanatory diagram illustrating the two loose ends of the binder according to this invention as they are poised on one over the other prior to mutual insertion.

FIG. 3 is an enlarged diagram showing the manner in which the end-to-end fastening of the binder according to this invention is completed.

FIG. 4 is an enlarged diagram showing the manner in which the end-to-end entanglement of the binder according to this invention is made.

DETAILED DESCRIPTION OF THE INVENTION

With reference to the drawings, the binder of this invention is so formed of a plastic material as to comprise a slender shaft 1 and a plurality of flanges 2 disposed at fixed intervals in the longitudinal direction of the said shaft. The interval L between each pair of adjacent flanges is slightly smaller than the diameter R of the flanges. The binder is wound around given articles. The loose remaining ends a and b of the binder are crossed each other at right angles and the intervals L and Lb between the corresponding pairs of adjacent flanges are confronted (FIG. 2). The two corresponding pairs of adjacent flanges 2*a* and 2*a'* and 2*b* and 2*b'* are forcibly pushed down toward the confronted intervals L*b* and L*a*, with the result that the two intervals of the shaft 1*a* and 1*b* slightly expand and bend in the shape of a bow and get entangled with each other. Because of the bending in the slender shaft, the adjacent flanges of each pair 2*a* and 2*a'* or 2*b* and 2*b'* are inclinded toward each other and consequently prevent the other pair of adjacent flanges from being disentangled. Thus, the adjacent flanges at one end of the binder are retained entangled with the corresponding interval at the other end of the shaft (FIG. 3). Because of this secure entanglement, the fastened state of the binder will not be impaired even when the loose ends a and b are pulled away in the opposite directions (indicated by the arrow marks A and B).

Actually when the intervals L*a* and L*b* and the loose ends *a* and *b* of the binder are crossed each other at right angles and the two pairs of adjacent flanges 2*a* and 2*a'* and 2*b* and 2*b '* are forcibly pushed down towards the confronted intervals L*b* and L*a*, the two flanges 2*a* and 2*a '* of the interval *a* or the two flanges of the other interval are inclined toward each other as illustrated in FIG. 4 so that the converged peripheries of the flanges are held up on one of the flanges 2*b* of the interval *b* and the diverged peripheries of the flanges rest astride the other flange 2*b'* of the same interval *b*. In this manner, the pairs of adjacent flanges are driven toward their confronted intervals L*b* and L*a* to complete a fastened state of FIG. 3.

Of course, by reversing the procedure described above, the fastened state can be cancelled with the same amount of force as required in accomplishing the engagement. The end-to-end fastening of the binder described above can simply be accomplished by crossing the loose remaining ends a and b of the binder wound around the objects, holding the two confronted intervals L*a* and L*b* between the inner surfaces of the thumb and the index finger and finally twisting them by about 90°. The fastened state can be broken by holding the loose ends and twisting them by the same amount of angle in the opposite direction.

The force required for establishing or breaking the fastened state increases and the binding force similarly increases with the increasing difference between L and R. This difference has its own limitation, however, because if the interval is shortened below a certain level, then the two pairs of adjacent flanges can no longer enter their respective confronted intervals.

The binder of the present invention can be made of any plastic material such as nylon 6, polyethylene or polypropylene insofar as the material has suitable elasticity.

A typical example of the binder according to this invention will be cited. This binder is made of polypropylne in such a construction that the slender shaft 1 has a diameter R of 0.8mm, the flanges 2 each measure 0.8mm in thickness and 3mm in diameter and the interval L between adjacent flanges is 2.1mm. Of course, these dimensions are solely illustrative. Products of various dimensions suited to intended applications may be obtained by suitably selecting the diameter R and the intervals L proportionately to the diameter of the slender shaft 1 and the thickness of the flanges 2 while taking into due consideration the expansibility of the slender shaft due to the elasticity of the plastic material used, the deformability of the flanges 2 and other similar factors.

In the actual fabrication of the binder, the first molding is to be performed so that in the produced mold, the shaft part has a larger diameter and the interval parts have a length about one quarter, for example, shorter than the corresponding parts which the final product is expected to possess. In the second molding, the first mold is drawn in such way that the slender shaft assumes the expected diameter and the intervals take up the expected length, giving rise to the final product. The fabrication of this method is advantageous in that the base 3 at which the slender shaft 1 joins each flange 2 is exposed to drawing to a lesser extent and, therefore, is finished in a conical shape to reinforce its connection with the flange, prevent the shaft from being torn while the shaft is bent along the joint with the flange and, at the same time, provide durability against repeated use of the binder.

When the binder of the present invention is used as for bundling a coil of electric wire, for example, the flanges on the inside of the looped portion of the binder wedge themselves into compact spaces occurring between adjacent surface coils of the bundled wire. Thus, the binder fastened around such coil has the effect of preventing the binder and the coil of electric wire from producing a relative rotary motion.

If one binder of the present invention fails to meet the purpose because of its limited length, then two or more binders can easily be joined to a required length by making the end-to-end fastening by following the procedure involved in bundling or binding given articles and the joined binders can be wound around the given articles in entirely the same way as described above.

What is claimed is:

1. A plastic binder comprising a slender flexible shaft and a plurality of disc-shaped flanges substantially coaxially disposed at uniform fixed intervals in the longitudinal direction of the said slender shaft, wherein the interval between each pair of adjacent flanges is substantially thirty percent smaller than the diameter of the flanges and said shaft and an adjacent pair of disc-shaped flanges located at one end of said binder can be angularly disposed to accept a pair of angularly disposed disc-shaped flanges and the joining part of said shaft located at a substantial distance along said binder when said binder is bent into an encircling confronting position.

* * * * *